US010145570B2

(12) United States Patent
Johnson

(10) Patent No.: US 10,145,570 B2
(45) Date of Patent: Dec. 4, 2018

(54) AIR CONDITIONER CONDENSER COIL COVERING AND FILTERING DEVICE

(71) Applicant: David Johnson, Kansas City, MO (US)

(72) Inventor: David Johnson, Kansas City, MO (US)

( * ) Notice: Subject to any disclaimer, the term of this patent is extended or adjusted under 35 U.S.C. 154(b) by 0 days.

(21) Appl. No.: 15/238,956

(22) Filed: Aug. 17, 2016

(65) Prior Publication Data

US 2017/0051927 A1 Feb. 23, 2017

Related U.S. Application Data

(60) Provisional application No. 62/206,415, filed on Aug. 18, 2015.

(51) Int. Cl.
*F24F 1/58* (2011.01)

(52) U.S. Cl.
CPC ..... *F24F 1/58* (2013.01)

(58) Field of Classification Search
CPC F24F 1/58; F28F 2265/02; B60P 7/04; B65D 90/021; E04H 15/00
See application file for complete search history.

(56) References Cited

U.S. PATENT DOCUMENTS 4,046,186 A * 9/1977 Nordstrom ..... B60P 7/04 160/368.1
4,745,769 A 5/1988 Wooden, Jr.
4,968,085 A * 11/1990 Stann ..... B60J 7/104 296/100.16
5,097,678 A * 3/1992 Aubuchon ..... F24F 1/50 150/154
5,307,849 A 5/1994 Nelson
5,809,800 A 9/1998 Deal
6,708,514 B1 3/2004 Miller
6,755,232 B1 * 6/2004 Holland ..... B65D 88/125 160/368.1
7,547,341 B2 6/2009 Sandberg
9,080,781 B1 * 7/2015 Turner ..... F24F 1/58
2006/0165931 A1 * 7/2006 Gaulrapp ..... F24F 1/58 428/36.1
2007/0204945 A1 * 9/2007 Ross ..... F24F 1/50 150/165
2008/0264021 A1 * 10/2008 Hoover ..... F24F 1/58 55/493
2010/0200038 A1 * 8/2010 Roman ..... E04H 15/001 135/144

(Continued)

*Primary Examiner* — Christopher R Zerphey
(74) *Attorney, Agent, or Firm* — Global Intellectual Property Agency, LLC; Daniel Boudwin

(57) ABSTRACT

An air conditioner condenser coil covering and filtering device for preventing dirt, debris, leaves, and the like from clogging an air conditioner condenser unit coils. The device includes a cover having a closed upper end, an open lower end, and one or more sidewalls extending therebetween, defining an interior volume, wherein the interior volume can receive a condenser. A slit extends from the lower end of the cover towards an upper end thereof so as to allow the cover to be moved between an open and closed configuration. A lower end of a sidewall can fold towards the upper end of the cover and secure onto a hook in order to enable the cover to remain in an open configuration for allowing access to the interior volume thereof. Fasteners extending from lateral sides of the slit secure across the slit to allow the cover to remain in a closed configuration.

18 Claims, 4 Drawing Sheets

(56) References Cited

U.S. PATENT DOCUMENTS

| | | | | |
|---|---|---|---|---|
| 2013/0160800 | A1* | 6/2013 | Steinmann | B08B 5/02 134/21 |
| 2016/0061483 | A1* | 3/2016 | DeLano | F24F 1/58 55/507 |

* cited by examiner

AIR CONDITIONER CONDENSER COIL COVERING AND FILTERING DEVICE

CROSS REFERENCE TO RELATED APPLICATION

This application claims the benefit of U.S. Provisional Application No. 62/206,415 filed on Aug. 18, 2015. The above identified patent application is herein incorporated by reference in its entirety to provide continuity of disclosure.

BACKGROUND OF THE INVENTION

The present invention relates to air conditioner condenser units. More specifically, the present invention provides a cover configured to enclose and filter an air conditioner condenser for preventing debris, leaves, and the like from entering the condenser unit.

Many residences and commercial buildings employ outdoor air conditioner condenser units in order to cool and heat the interior thereof. Due to the outdoor proximity of the air conditioner condensers units, the condenser units are exposed to insects, dirt, debris, leaves, and the like. These elements cause the air conditioner condenser unit coils to become clogged, thereby interfering with the efficient operation of the condenser unit, resulting in temperature regulation inefficiency of the residence or building. If an air conditioner condenser unit is unable to operate at full-capacity, it becomes a financial burden to a user due to having to run the air conditioner more often, requiring a professional to service the air conditioner condenser unit, or needing to purchase replacement parts for the condenser unit, or a combination thereof.

Devices have been disclosed that relate to air conditioner condenser filters. These devices generally relate to multi-piece filters that cover portions of the air conditioner condenser. However, these devices fail to provide a cover that encloses the sides and upper end of an air conditioner condenser unit, wherein the lower end of the cover can fold towards the upper end via a slit and secure onto a hook in order to enable the cover to remain in an open configuration for allowing access to an interior volume thereof.

In light of the devices disclosed in the prior art, it is submitted that the present invention substantially diverges in design elements from the prior art and consequently it is clear that there is a need in the art for an improvement to existing air conditioner condenser coil covering and filtering devices. In this regard the instant invention substantially fulfills these needs.

SUMMARY OF THE INVENTION

In view of the foregoing disadvantages inherent in the known types of air conditioner condenser coil covering and filtering devices now present in the prior art, the present invention provides a new air conditioner condenser coil covering and filtering device wherein the same can be utilized for providing convenience for the user when protecting an air conditioner condenser unit from becoming clogged by dirt and debris.

It is therefore an object of the present invention to provide a new and improved air conditioner covering device that has all of the advantages of the prior art and none of the disadvantages. The air conditioner condenser coil covering and filtering device includes a cover having a closed upper end, an open lower end, and one or more sidewalls extending therebetween, defining an interior volume, wherein the interior volume can receive a condenser unit. A slit extends from the lower end of the cover towards an upper end thereof so as to allow the cover to be moved between an open and closed configuration. A lower end of a sidewall can fold towards the upper end of the cover and secure onto a hook in order to enable the cover to remain in an open configuration for allowing access to the interior thereof. Fasteners extending from lateral sides of the slit secure across the slit to allow the cover to remain in a closed configuration.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
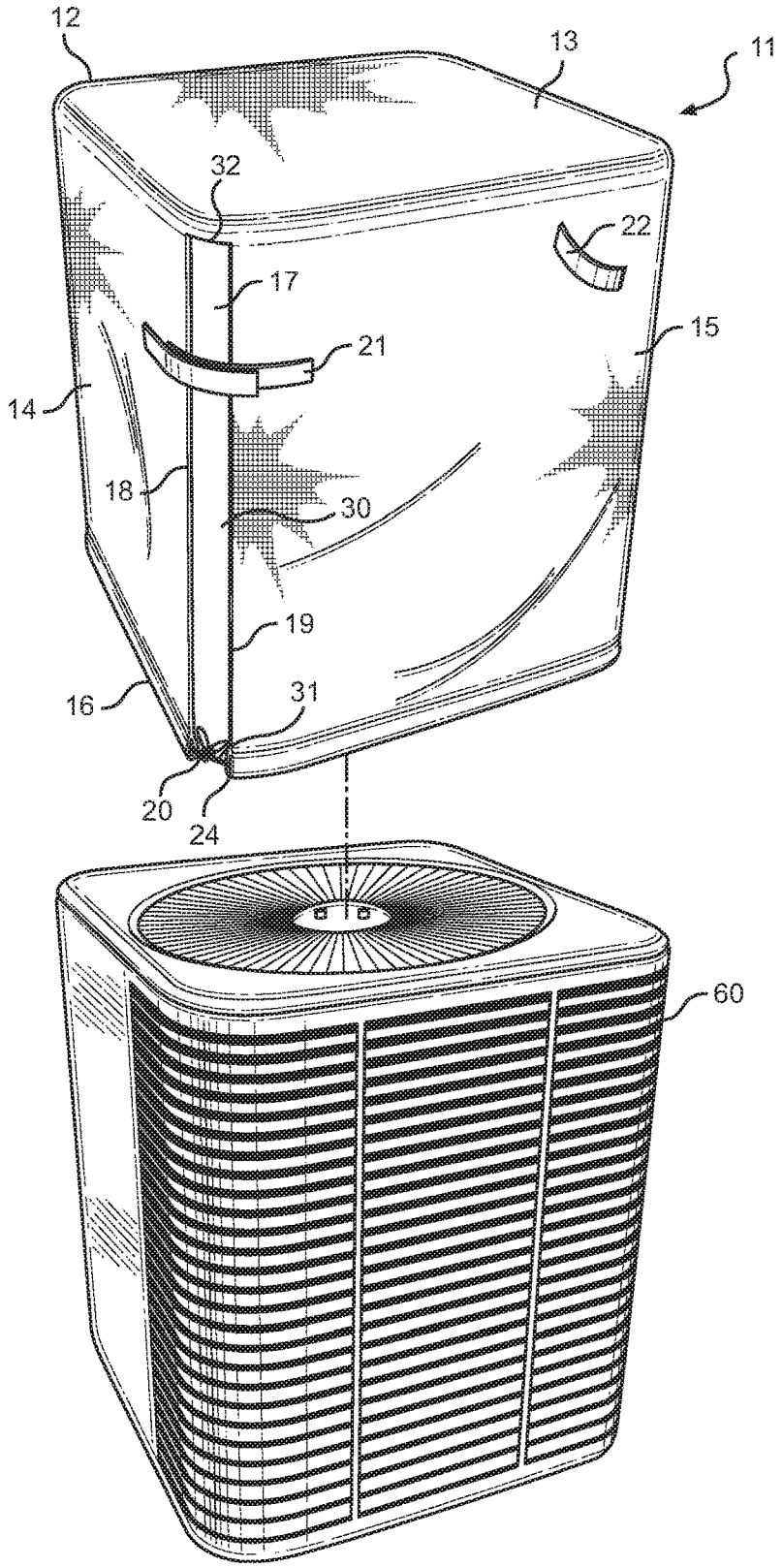
FIG. 1 shows a perspective view of the air conditioner condenser coil covering and filtering device positioned above an air conditioner condenser unit.

Reference is made herein to the attached drawings. Like reference numerals are used throughout the drawings to depict like or similar elements of the air conditioner condenser unit. For the purposes of presenting a brief and clear description of the present invention, the preferred embodiment will be discussed as used for protecting an air conditioner condenser unit from becoming clogged by dirt and debris. The figures are intended for representative purposes only and should not be considered to be limiting in any respect.

Figure 2:
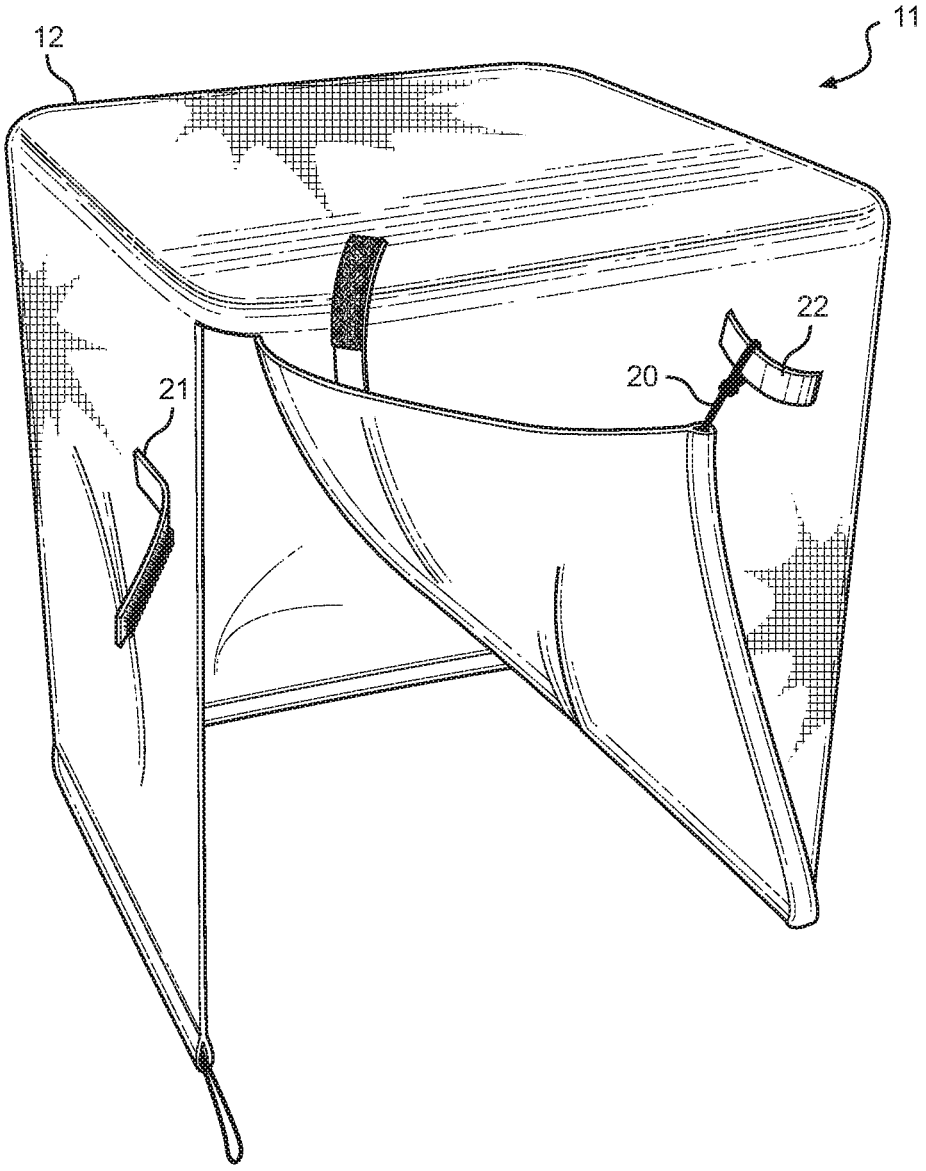
FIG. 2 shows a perspective view of the air conditioner condenser coil covering and filtering device in an open configuration.

Referring now to FIGS. 1 and 2, there is shown a perspective view of the air conditioner condenser coil covering and filtering device positioned above an air conditioner condenser unit and a perspective view of the air conditioner condenser coil covering and filtering device in an open configuration, respectively. The present invention 11 comprises a cover 12 having one or more sidewalls 14 extending between an open lower end 16 and a closed upper end 13, defining an interior volume. The interior volume of the cover 12 is configured to receive an air conditioner condenser unit 60 through the open lower end 16 thereof. In some embodiments, the present invention 11 includes the air conditioner condenser unit 60.

The upper end 13 of the cover is configured to rest above an upper end of the unit 60. The sidewalls 14 are configured to cover the sides of the unit 60. In this way, the condenser unit 60 is enclosed by the cover 12 so as to serve as filter and prevent insects, debris, leaves, and the like from entering and clogging the condenser unit. In the illustrated embodiment, the cover 12 comprises a square cross section in order to enclose a condenser unit 60 having a square cross section.

In other embodiments, the cover 12 comprises a shape corresponding to the shape of the condenser unit 60 in which it is configured to enclose.

In the illustrated embodiment, the cover 12 is composed of a mesh material configured to allow air and moisture to pass therethrough. In this way, moisture does not become trapped underneath the cover 12 when it is disposed over the condenser unit 60 so as to prevent corrosion of the unit 60. In other embodiments, the cover 12 is composed of any suitable material configured to prevent leaves, dirt and insects from entering the condenser unit, while still allowing air and moisture to flow freely through the cover 12. In the illustrated embodiment, the sidewalls 14 and upper end 13 of the cover 12 are integral to one another.

The air conditioner condenser coil covering and filtering device 11 further comprises a slit 17 having a first end 31 and a second end 32, wherein the slit 17 allows the cover 12 to move between an open and closed configuration. The first end 31 of the slit 17 extends from the lower end 16 of the cover 12 and the second end 32 extends towards the upper end 13 thereof. In the illustrated embodiment, the slit 17 is configured to align to with a corner of a pair of adjacent sidewalls of the condenser unit 60. The slit 17 comprises a first side 18 and a second side 19 and a gap 30 disposed therebetween. The gap 30 in the slit 17 allows piping extending from the condenser unit 60 to pass through the cover 12.

In the closed configuration, the sides 18, 19 of the slit 17 are parallel to one another. A first fastener removably secures the cover 12 in a closed configuration by connecting the sides 18, 19 of the first end 31 of the slit 17 to one another. In the illustrated embodiment, the first fastener comprises a channel 24 disposed along the periphery of the lower end 16 of the cover 12 and a cord 20, wherein the cord 20 extends through the channel 24. The cord 20 freely moves within the channel 24. The channel 24 comprises a pair of open ends, wherein each end is disposed along a side 18, 19 of the slit. A first and second end of the cord 20 extend through the open ends of the channel 24 and are configured to removably secure to one another by any suitable fastener, such as a tie. In the closed configuration, the cord 20 forms a loop and is preferably positioned beneath piping extending from the condenser unit so as to further secure the cover 12 thereto.

In some embodiments, a second fastener 21 is removably disposed over the second end 32 of the slit 17 so as to secure the cover 12 in a closed position. In the illustrated embodiment, the second fastener 21 comprises a first strap extending from a first side 18 of the slit 17 and a second strap extending from the second side 19 of the slit 17. The straps are securable to one another by any suitable fastener, such as hook and loop material. In this way, the first side 18 of the slit 17 is able to remain substantially parallel to the second side 19 of the slit 17.

In an open configuration, the sides 18, 19 of the first end 31 of the slit 17 are separated from one another. As the sides 18, 19 of the slit 17 are separated, the interior volume of the cover 12 is accessible, thereby allowing a user to easily remove the covering device from a condenser unit 60 or simply accessing a condenser unit 60 disposed within the interior volume thereof. In the illustrated embodiment, a hook 22 is disposed on a sidewall 14 adjacent to a side 19 of the slit 17. The hook 22 is disposed on a sidewall 14 adjacent to the slit 17. The hook 22 is disposed on a side 15 of the sidewall 14 opposite to the side of the sidewall 14 that serves as the side 19 of the slit 17. In this way, a lower end of the sidewall 14 is adapted to fold towards the upper end 13 of the cover 12 and secure onto the hook 22 in order to enable the cover 12 to remain in an open configuration. The cord 20 extending from the channel 24 is adapted to be connected to the hook 22 so as to allow the sidewall 14 to remain lifted upwards and the cover 12 disposed in an open configuration.

Figure 3:
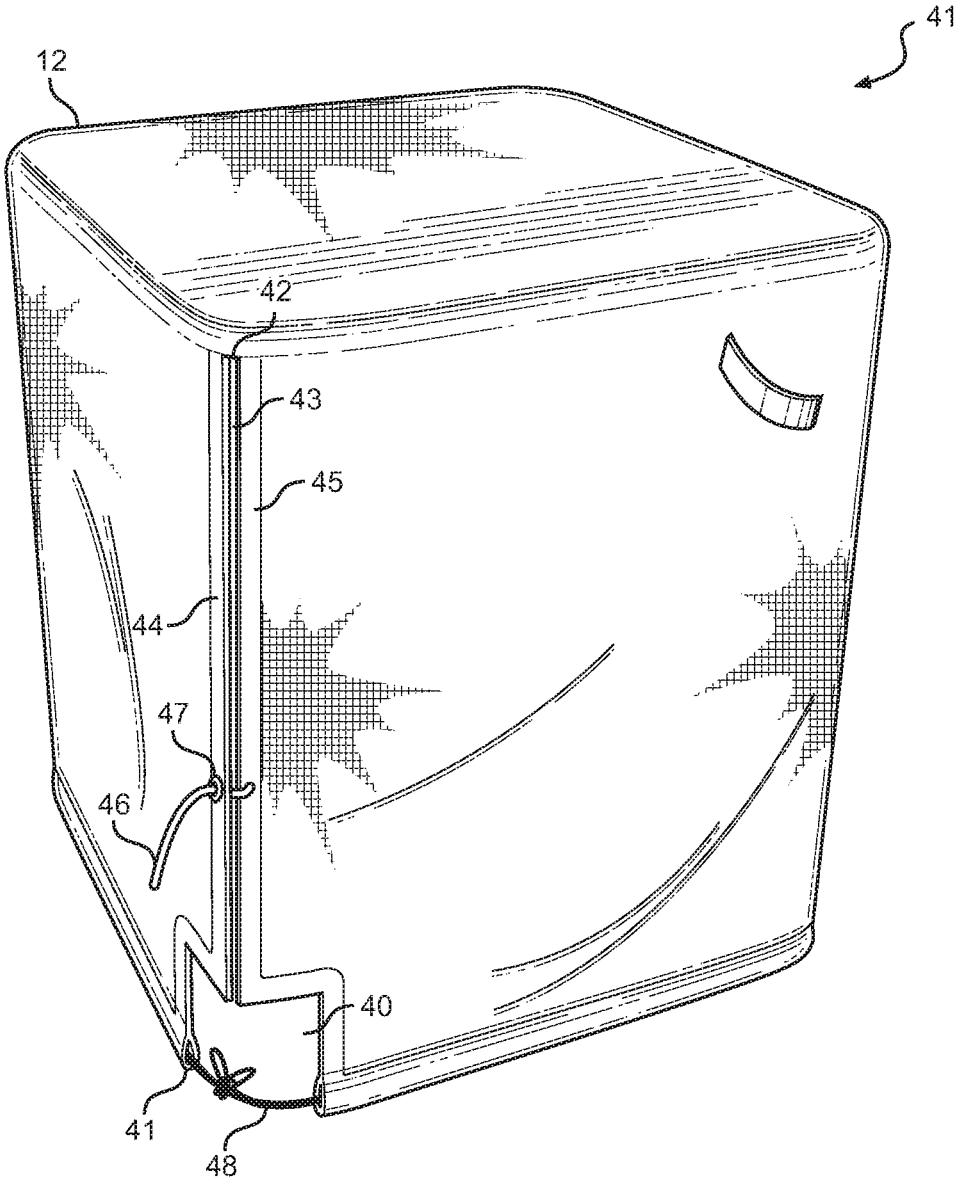
FIG. 3 shows a perspective view of an alternate embodiment of the air conditioner condenser coil covering and filtering device.

Referring now to FIG. 3, there is shown a perspective view of an alternate embodiment of the air conditioner condenser coil covering and filtering device. In an alternate embodiment of the device 41, the first side 44 of the slit 43 rest flush against the second side 45 of the slit 43 in the closed configuration. Further, an opening 40 is disposed at the first end 41 of the slit 43, wherein the opening 40 is configured to receive pipes extending from the lower end of the condenser unit therethrough.

In an alternate embodiment, the second fastener is disposed on the second end 42 of the slit 43 and comprises an aperture 47 disposed on the first side 44 of the slit 43 and a cord 46 extending from the second side 45 of the slit 43, wherein the aperture 46 is configured to removably receive the cord 46 therethrough. The cord 46 is fastened to the aperture via any suitable means, such as a knot tied at the end of the cord 46 so as to prevent the cord 46 from being removed from the aperture 47. The second fastener allows the first and second ends 44, 45 of the slit 43 to remain parallel and flush against one another. The first fastener is disposed adjacent to the first end 41 of the slit 43, beneath the opening 40.

Figure 4:
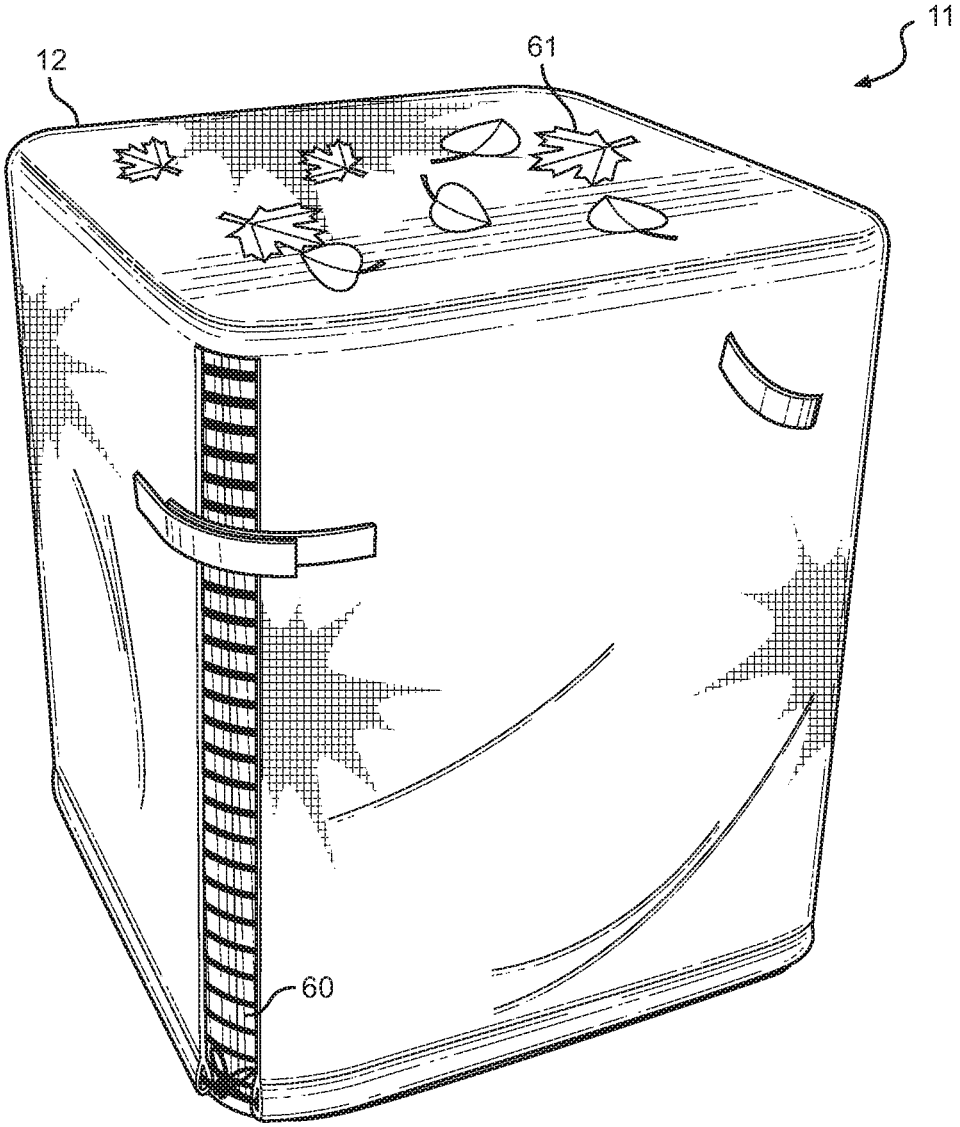
FIG. 4 shows a perspective view of the air conditioner condenser coil covering and filtering device in use.

Referring now to FIG. 4, there is shown a perspective view of the air conditioner condenser coil covering and filtering device in use. In operation, the cover 12 is disposed in an open configuration so as to allow the air conditioner condenser coil covering and filtering device 11 to be placed over an air conditioner condenser unit 60. The cover 12 serves to filter the air condenser unit coils by preventing leaves, dirt, insects, and the like from entering and clogging the condenser unit coils. If a user needs to remove the cover 12 or access the condenser unit 60, the first and second fasteners are unsecured and a sidewall is lifted upwards to an open configuration, such that the sidewall is secured to the hook on the exterior of the cover 12. The user disconnects the lower end of the sidewall from the hook and secures the first and second fasteners in order to dispose the cover in a closed configuration.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An air conditioner condenser coil covering and filtering device, comprising:

a cover having a closed upper end, an open lower end, and one or more sidewalls disposed therebetween, defining an interior volume, wherein the interior volume is configured to receive an air conditioner condenser unit;

a slit having a first end and a second end, wherein the first end extends from the open lower end of the cover and the second end extends towards the closed upper end of the cover;

a fastener disposed on a lower end of a first one of the one or more sidewalls configured to removably secure the lower end of the slit in a closed configuration, such that a first side of the slit is parallel to a second side of the slit;

a hook disposed on an upper corner of the first of the one or more side sidewalls diagonally opposite to the fastener, wherein the hook is configured to receive the fastener.

2. The air conditioner condenser coil covering and filtering device of claim 1, wherein the cover comprises at least two of the one or more sidewalls and the slit is disposed between a first sidewall and a second sidewall of the one or more sidewalls.

3. The air conditioner condenser coil covering and filtering device of claim 1, wherein the lower end of the one or more sidewalls comprises a channel extending along the periphery thereof in order to receive a cord therethrough.

4. The air conditioner condenser coil covering and filtering device of claim 3, further comprising the cord extending through the channel, wherein the cord includes a first end removably securable to a second end so as to form a loop.

5. The air conditioner condenser coil covering and filtering device of claim 1, wherein the cover is composed of mesh.

6. The air conditioner condenser coil covering and filtering device of claim 1, wherein a gap is disposed between the first side and second side of the slit.

7. The air conditioner condenser coil covering and filtering device of claim 1, wherein the second end of the slit extends to the closed end of the cover.

8. The air conditioner condenser coil covering and filtering device of claim 1, wherein a first side of the one or more sidewalls is foldable so as to dispose the cover in an open configuration.

9. The air conditioner condenser coil covering and filtering device of claim 8, wherein the hook allows the cover to remain in an open configuration such that the first side of the slit is separated from the second side of the slit.

10. The air conditioner condenser coil covering and filtering device of claim 1, further comprising a first strap secured to the first side of the slit and a second strap secured to the second side of the slit, wherein the first strap is removably securable to the second strap so as to secure the cover in the closed configuration.

11. The air conditioner condenser coil covering and filtering device of claim 10, wherein the first strap comprises hook material and the second strap comprises loop material.

12. The air conditioner condenser coil covering and filtering device of claim 1, wherein the one or more sidewalls and the closed upper end of the cover are integral to one another.

13. The air conditioner condenser coil covering and filtering device of claim 1, further comprising an opening at the first end of the slit, wherein the opening is configured to receive piping therethrough.

14. An air conditioner condenser coil covering and filtering device, comprising:

an air conditioner condenser unit;

a cover having a closed upper end, an open lower end, and one or more sidewalls disposed therebetween, defining an interior volume, wherein the interior volume is configured to receive an air condition condenser unit;

a slit having a first end and a second end, wherein the first end extends from the open lower end of the cover and the second end extends towards the closed upper end of the cover;

a fastener disposed on a lower end of a first one of the one or more sidewalls configured to removably secure the lower end of the slit in a closed configuration, such that a first side of the slit is parallel to a second side of the slit;

a hook disposed on an upper corner of the first of the one or more side sidewalls diagonally opposite to the fastener, wherein the hook is configured to receive the fastener.

15. The air conditioner condenser coil covering and filtering device of claim 1, wherein the cover and one or more sidewalls are composed of a single uniform thickness.

16. The air conditioner condenser coil covering and filtering device of claim 6, wherein the gap extends between the distal most ends of the slit.

17. The air conditioner condenser coil covering and filtering device of claim 9, wherein in the open configuration the fastener is removably secured to the hook such that one of the one or more sidewalls is folded in half to form a triangular cross-section.

18. An air conditioner condenser coil covering and filtering device, consisting of:

a cover having a closed upper end, an open lower end, and one or more sidewalls disposed therebetween, defining an interior volume, wherein the interior volume is configured to receive an air conditioner condenser unit;

a slit having a first end and a second end, wherein the first end extends from the open lower end of the cover and the second end extends towards the closed upper end of the cover;

a fastener disposed on a lower end of a first one of the one or more sidewalls configured to removably secure the lower end of the slit in a closed configuration, such that a first side of the slit is parallel to a second side of the slit;

a hook disposed on an upper corner of the first of the one or more side sidewalls diagonally opposite to the fastener, wherein the hook is configured to receive the fastener.

* * * * *